United States Patent [19]

Gautier et al.

[11] Patent Number: 4,603,433

[45] Date of Patent: Jul. 29, 1986

[54] BAG WITH HANDLE USABLE AS A STOPPER

[75] Inventors: Raoul Gautier; Michel Cazes, both of Vittel, France

[73] Assignee: Societe General des Eaux Minerales de Vittel, Vittel, France

[21] Appl. No.: 671,567

[22] Filed: Nov. 15, 1984

[30] Foreign Application Priority Data

Nov. 15, 1984 [FR] France ..... 83 18256

[51] Int. Cl.[4] ..... B65D 33/06

[52] U.S. Cl. ..... 383/7; 383/13; 383/25; 383/96

[58] Field of Search ..... 383/7, 13, 25, 96

[56] References Cited

U.S. PATENT DOCUMENTS

| | | | |
|---|---|---|---|
| 1,204,068 | 11/1916 | Robin et al. | 383/25 |
| 1,798,094 | 3/1931 | Malvern et al. | 383/96 |
| 4,223,810 | 9/1980 | Sneider | 383/96 |
| 4,361,235 | 11/1982 | Gautier | 383/7 |
| 4,377,192 | 3/1983 | Gautier | 383/7 |

FOREIGN PATENT DOCUMENTS

| | | | |
|---|---|---|---|
| 222586 | 12/1961 | Austria | 383/96 |
| 826707 | 4/1938 | France | 383/96 |

*Primary Examiner*—Stephen P. Garbe

*Attorney, Agent, or Firm*—Prutzman, Kalb, Chilton & Alix

[57] ABSTRACT

A bag made of flexible synthetic material is provided with a removable stiffening element that can serve as both a handle and a stopper element after the bag has been opened.

7 Claims, 4 Drawing Figures

BAG WITH HANDLE USABLE AS A STOPPER

The present invention relates to a bag made of flexible synthetic material for the packaging of liquids, of the type incorporating a stiffening and gripping handle consisting essentially of a rigid or semi-rigid element located inside a secondary cavity separated from the main cavity containing the liquid by a continuous weld line.

The invention also relates to a string of such bags.

Bags of this type are known. They were the subject of U.S. Pat. No. 4,377,192 corresponding to French Patent Application No. 80/02,187 in the applicant's name.

The bags described in this prior U.S. Pat. No. 4,377,192 to which express reference is made here, all have a firm stiffening means incorporated in the secondary cavity mentioned above. The various solutions proposed give full satisfaction.

The bag is opened by cutting off the upper corner opposite the handle.

However, it was noted that one of the problems facing the user was to restopper the bag after first use. In fact, it is highly unlikely that the content of such a bag, for example one liter, will be used all at once, and it is therefore necessary, simply because of hygiene and safety, to be able to restopper the bag.

Because it was seen that the need to restopper the bag arises when it is no longer necessary to grip it, it was decided that an attempt should be made to reconcile the requirements of these two functions.

Consequently, the object of the present invention is to propose a bag of the type described above, which makes it possible, at the least possible cost, to optimise the requirements of the gripping function, on the one hand, and the stoppering function, on the other hand.

According to the invention, this result is achieved by means of a bag made of flexible synthetic material for the packaging of liquids, of the type incorporating a stiffening and gripping handle consisting essentially of a rigid or semi-rigid element located inside a secondary cavity separated from the main cavity containing the liquid by a continuous weld line, wherein the rigid or semi-rigid element is arranged removably in the said secondary cavity, so that it can be used as an element for stoppering the bag after the latter has been opened.

Thus, the same element is used, in succession, to grip and stopper the bag. Of course, this element can assume many forms which simply have to be compatible with the two functions.

Advantageously, the rigid element will take the form of an oblong hollow body which is necessarily closed off at least at one of its ends and which is of a general tapered shape. It will preferably have cross-sections without any sharp angles.

In comparison with the embodiments of the prior art, this embodiment has many advantages, such as, in a non-limiting way:

the provision of simple stoppering which can easily be understood by any user, a saving because only one element is used for two different functions, an additional advantage is afforded, without prejudicing the other parameters (tamper-proofing, etc.).

The rigid element can be made of any synthetic material of food quality. It can also serve as an advertising or consumer-information medium.

Since the bags which are the subject of the invention can also be presented in the form of strings of bags and not individually, only one rigid element will be sufficient for each string, and this ensures an additional saving of material.

The invention will be understood more clearly by means of the following description of a non-limiting embodiment, with reference to the attached drawings in which.

Figure 1:
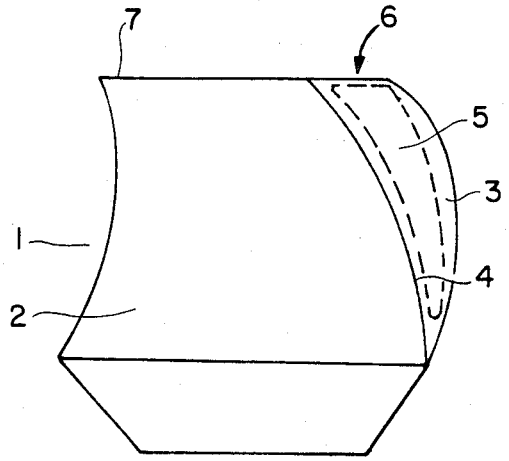
FIG. 1 is a diagrammatic side elevation view of the bag according to the invention.

The bag (1) is composed, in a way known per se and which therefore will not be explained in any more detail, of a main cavity (2) intended for receiving the liquids to be packaged and a secondary cavity (3) separated from the said main cavity by a continuous weld line (4) of any shape, whether rectilinear or not.

The bottom of the bag can be of any structure, for example in the form of a W or flat.

The two walls of the bag can originate from one and the same film folded suitably or from two separate strips.

In the same way, the bag can be produced either in a so-called horizontal machine or in a vertical machine using a vertical mandrel for forming the film into a sheath.

According to the invention, a removable rigid element (5) is located in the cavity (3).

Figure 4:
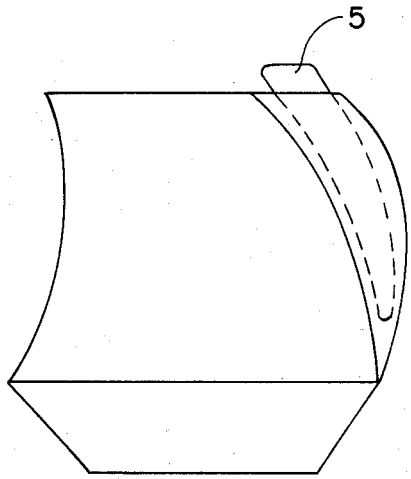
FIG. 4 is a diagrammatic side elevational view of the bag of FIG. 1 with the rigid element projecting from the handle cavity.

The cavity (3) can, for example, be open at its upper edge to allow the element (5) to be removed by the user. If appropriate, the element (5) will project slightly beyond the cavity (3) as illustrated in FIG. 4.

The cavity (3) can also be closed by a weld line (6) provided, if appropriate, with a predetermined cutting line. The user therefore uses, for example, scissors to cut this line, or he tears along the predetermined cutting line. Hygiene is safeguarded in this way.

Figure 2:
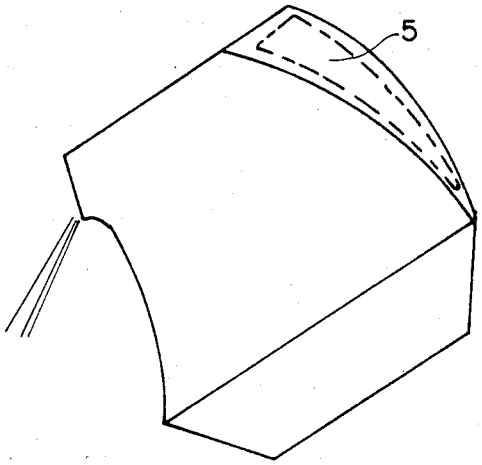
FIG. 2 is a diagrammatic side elevation view of the bag of FIG. 1 in the pouring position.

For actual pouring, the user cuts off in a conventional way the upper corner (7) of the bag opposite the handle to define a pouring orifice (8). Pouring is illustrated in FIG. 2, the rigid element (5) being located in the cavity (3) and thus performing its stiffening function for pouring purposes.

Figure 3:
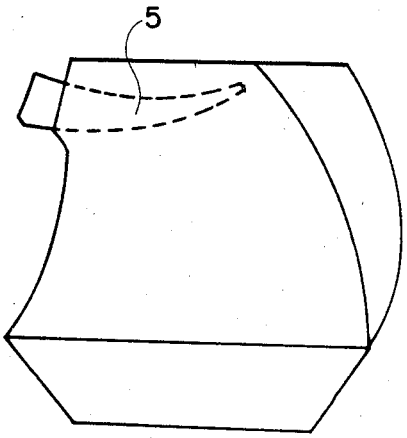
FIG. 3 is a diagrammatic side elevation view of the bag of FIG. 1 in the stoppering position.

Once pouring has ended, the user removes the element (5) and puts it in the orifice (8) as shown in FIG. 3.

To ensure that the element (5) is compatible with all the diameters of orifices 8, which are random except when there is a predetermined cutting line or a specific opening zone as a result of cutting by means of scissors, the cross-section of the oblong element (5) will decrease progressively from one end of the element to the other. In this way, it will also become easier to insert it into the orifice (8).

The element (5) will preferably be closed off, for reasons of hygiene, at its end of least cross-section.

As shown in FIG. 3, it will be noted that, when functioning as a stopper, the element (5) can also serve as an element for gripping and carrying the bag when it is held at the top. In this way, the stopper and the content of the bag are prevented from being expelled inopportunely, as compared with gripping and carrying the bag laterally.

It is clear that the element (5) can assume any form and cross-section compatible with its functions. It can be either transparent or not and can be closed off at both ends.

The element (5) will preferably be inserted frictionally in the cavity (3) which will therefore be adjusted as accurately as possible to allow the bag to be gripped more effectively during pouring.

The invention also relates to strings of bags of this type which can be aligned vertically or horizontally. In a highly advantageous way, the string will incorporate a single rigid handle, and the element (5) can be used for each bag in succession.

We claim:

1. In a bag made of flexible synthetic material for the packaging of liquids, of the type incorporating a stiffening and gripping handle consisting essentially of a rigid or semi-rigid element located inside a secondary cavity separated from the main cavity containing the liquid by a continuous weld line, the improvement wherein said secondary cavity is opened at its upper edge, and the rigid or semi-rigid element is removably arranged in said secondary cavity and projects beyond said secondary cavity so that it can be used as an element for stoppering the bag after the latter has been opened.

2. A bag as claimed in claim 1, wherein the element (5) is an oblong hollow body made of synthetic material, closed off at least at one of its ends and of a general tapered shape.

3. A bag as claimed in claim 2, wherein the cross-section of the element (5) decreases progressively from one end of the element to the other, and wherein the said element is closed off at its end of least cross-section.

4. A bag as claimed in claim 1, wherein the cavity (3) is formed by a weld line (6).

5. A bag as claimed in claim 4, wherein the weld line (6) is coupled with a predetermined cutting line.

6. A bag as claimed in claim 1, wherein the element (5) is frictionally held in the cavity (3).

7. A string of bags as claimed in claim 1, which incorporates a single element (5).

* * * * *